United States Patent [19]

Edwards

[11] Patent Number: 4,734,068

[45] Date of Patent: Mar. 29, 1988

[54] MOUNTING STRUCTURE FOR ELECTRIC TROLLING MOTORS

[75] Inventor: James R. Edwards, Dubuque, Iowa

[73] Assignee: The Eska Company, Dubuque, Iowa

[21] Appl. No.: 884,536

[22] Filed: Jul. 11, 1986

[51] Int. Cl.[4] ..... B63H 5/12

[52] U.S. Cl. ..... 440/56; 440/63

[58] Field of Search ..... 440/6, 51, 55, 52, 56, 440/63, 65; 114/140, 141, 130, 132, 133, 144 R, 162, 163

[56] References Cited

U.S. PATENT DOCUMENTS 3,073,279 1/1963 Moody ..... 440/56

*Primary Examiner*—Joseph F. Peters, Jr.
*Assistant Examiner*—Jesûs D. Sotelo
*Attorney, Agent, or Firm*—James C. Nemmers

[57] ABSTRACT

A mounting structure especially for electric outboard trolling motors that allows the motor and its supporting structure to pivot over a wide range if a submerged object is struck by the submerged motor. The mounting structure permits this release regardless of whether the boat is moving forward or in reverse. After the submerged object is passed, the mounting structure will automatically reset itself to the normal operating position.

9 Claims, 3 Drawing Figures

48
52
14
29
54
50
40
46
42
42
44
34
30
36
38
27
34
32
30
24
38
42
46
34
44
28

MOUNTING STRUCTURE FOR ELECTRIC TROLLING MOTORS

BACKGROUND OF THE INVENTION

The invention relates generally to mounting structures for outboard motors, especially electric trolling motors of the type that are commonly mounted on the bow of a fishing boat. The electric trolling motor is generally suspended beneath the surface of the water from a mounting structure that is attached to the bow of the boat. There are known and used various different types of mounting brackets, but the usual structure is to suspend the electric motor and the propeller driven by it at the bottom end of a vertical tube that is gripped by a portion of the mounting bracket. Since the electric trolling motor is beneath the surface of the water, it not infrequently happens that the motor will strike a submerged object which can cause damage to the motor and to the mounting structure.

In order to minimize the damage to the motor and mounting structure, a variety of different mounting structures have been developed over the years in an attempt to absorb the shock of the motor striking an underwater object. A recent design of this general type is shown in U.S. Pat. No. 4,555,233, issued Nov. 26, 1985 to Mark S. Klammer and Del P. Decko for their invention entitled "Shock-Absorbing Bow Mount for Trolling Motors". The device disclosed in this patent has an array of four springs, two upper springs and two lower springs which surround pins interconnecting the motor mounting structure with the mounting bracket that is affixed to the boat. With the structure disclosed in this patent, when the impact is from either direction, either the upper or lower springs will serve as shock absorbers. However, the patent merely describes a shock-absorbing structure and does not permit the submerged electric motor to move through a very wide range and thus move over and out of the way of a submerged object. Moreover, when in normal operating position, there is no positive connection between the mounting structure for the motor and the mounting structure affixed to the boat. In effect, the structure shown in this patent is in reality merely a shock absorbing structure and does not permit any actual release of the motor from its mounting structure on the boat whenever a submerged object is struck.

Other patents of the prior art, many of which are listed in U.S. Pat. No. 4,555,233 allow pivoting movement of the electric trolling motor when a submerged object is struck in one direction but not when the boat is moving in the other direction. Also, none of these prior art patents disclose a structure which permits a wide range of pivoting combined with an automatic reset to the normal operating position.

There is therefore a need for an improved mounting structure for an electric trolling motor which permits the motor to move over a submerged object when struck regardless of the direction or travel of the boat, and a structure which will permit the mounting structure to return to its normal operating position automatically and thereafter provide a positive drive between the motor and the boat.

SUMMARY OF THE INVENTION

The structure of the invention includes a mounting bracket that is secured to the bow mount supporting assembly. The bracket has a curved elongated slot extending horizontally through it, with vertical surfaces on each side of the bracket forming a ramp extending outwardly toward both the front and rear of the bracket. A thrust pin extends through the elongated slots and through thrust pads which are engaged with the ramps on each side of the bracket. The thrust pads are biased toward the ramps by means of compression springs. The thrust pin extends through an opening in the mounting bracket which supports the vertical tube at the lower end of which is the electric motor. The elongated slot is curved on a radius the center of which is the pivot for the bracket supporting the motor and its operating tube. Sufficient force is exerted by the compression springs on the thrust pads to normally maintain the thrust pin in the center of the elongated slot at the lowest point of the thrust ramps. In this position, the motor will be in its normal operating position and the vertical tubes supporting it will be in a vertical position. However, if a submerged object is struck by the motor when the boat is moving either fore or aft, the force will be sufficient to overcome the force exerted by the compression springs on the thrust pads and the motor supporting bracket will be allowed to pivot until the thrust pin reaches the outermost end of the curved elongated slot. When the submerged object is passed, the force of the compression springs along with the force exerted by the thrust of the motor will return the mounting bracket and the motor to its normal operating position.

DESCRIPTION OF THE PREFERRED EMBODIMENT OF THE INVENTION

Figure 1:
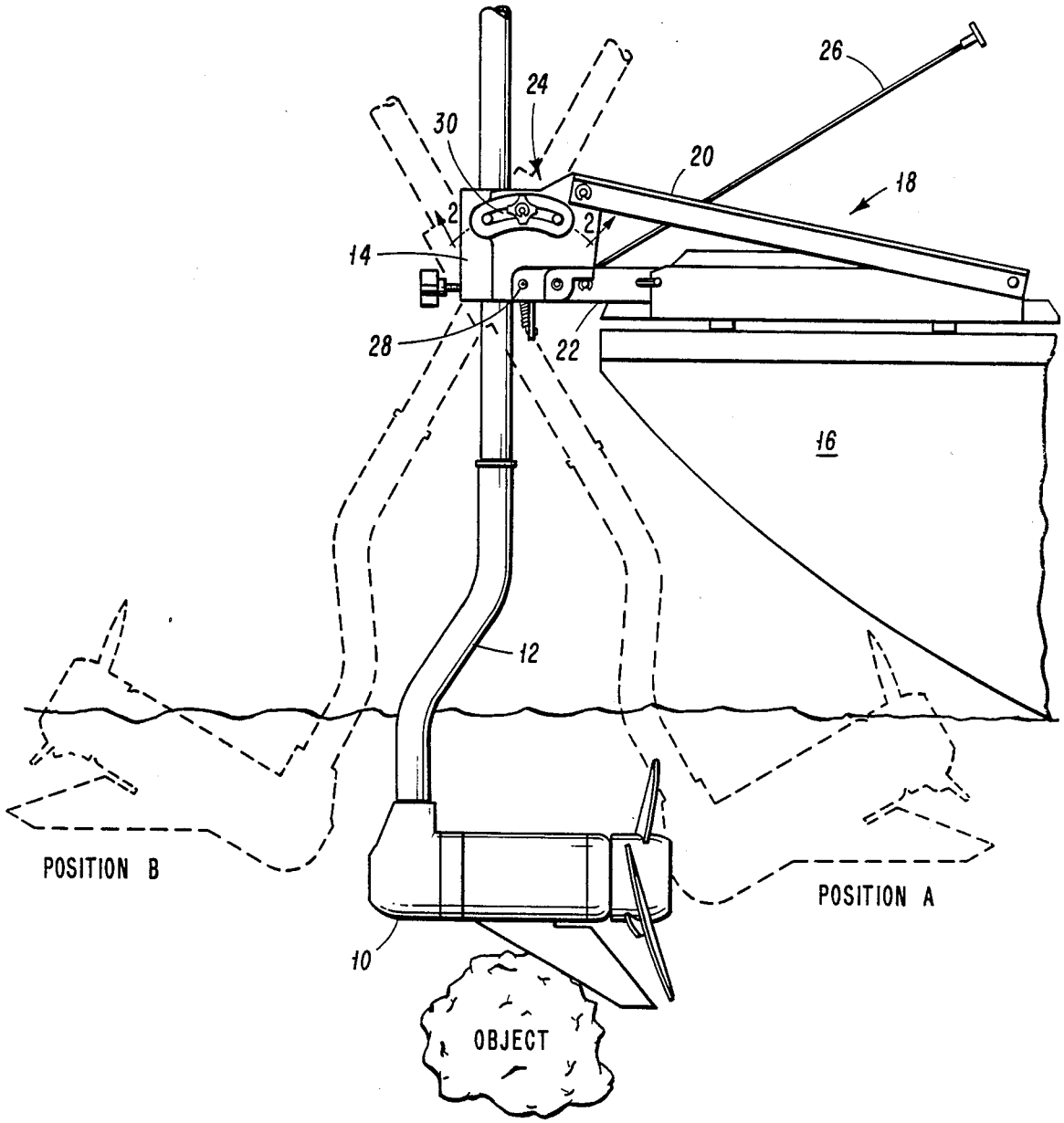
FIG. 1 is a side elevational view illustrating the mounting of an electric trolling motor on the bow of a boat and illustrating the release feature of the invention.

Referring first to FIG. 1, there is illustrated an electric trolling motor and propeller assembly 10 affixed to the lower end of an elongated motor tube 12 which extends through and is held by a swivel mounting bracket 14. As is well known to those skilled in the art, at the upper end of the motor tube 12 would be a housing containing the controls for supplying power to drive the motor 10 and to turn the motor 10 and tube 12 so as to steer the boat to which the motor assembly is secured.

The bow 16 of a boat contains a bow-mount bracket assembly indicated generally by the reference numeral 18. These assemblies can be of a variety of designs, but generally include an arrangement which has a pair of upper support arms 20 and a lower arm 22 pivotally secured at their outer ends to a mounting bracket indicated generally by the reference numeral 24. The bow mount assembly 18 is customarily designed so that the motor can be swung to the operating position shown in FIG. 1, and when the electric trolling is not in use, the motor assembly 10 and its associated supporting structure can be pivotally swung to a storage position by pulling a cord and handle assembly 26 upwardly so that the motor and motor tube will rest in a generally horizontal storage position on the bow 16 of the boat. This is as is well known to those skilled in the art.

Figure 3:
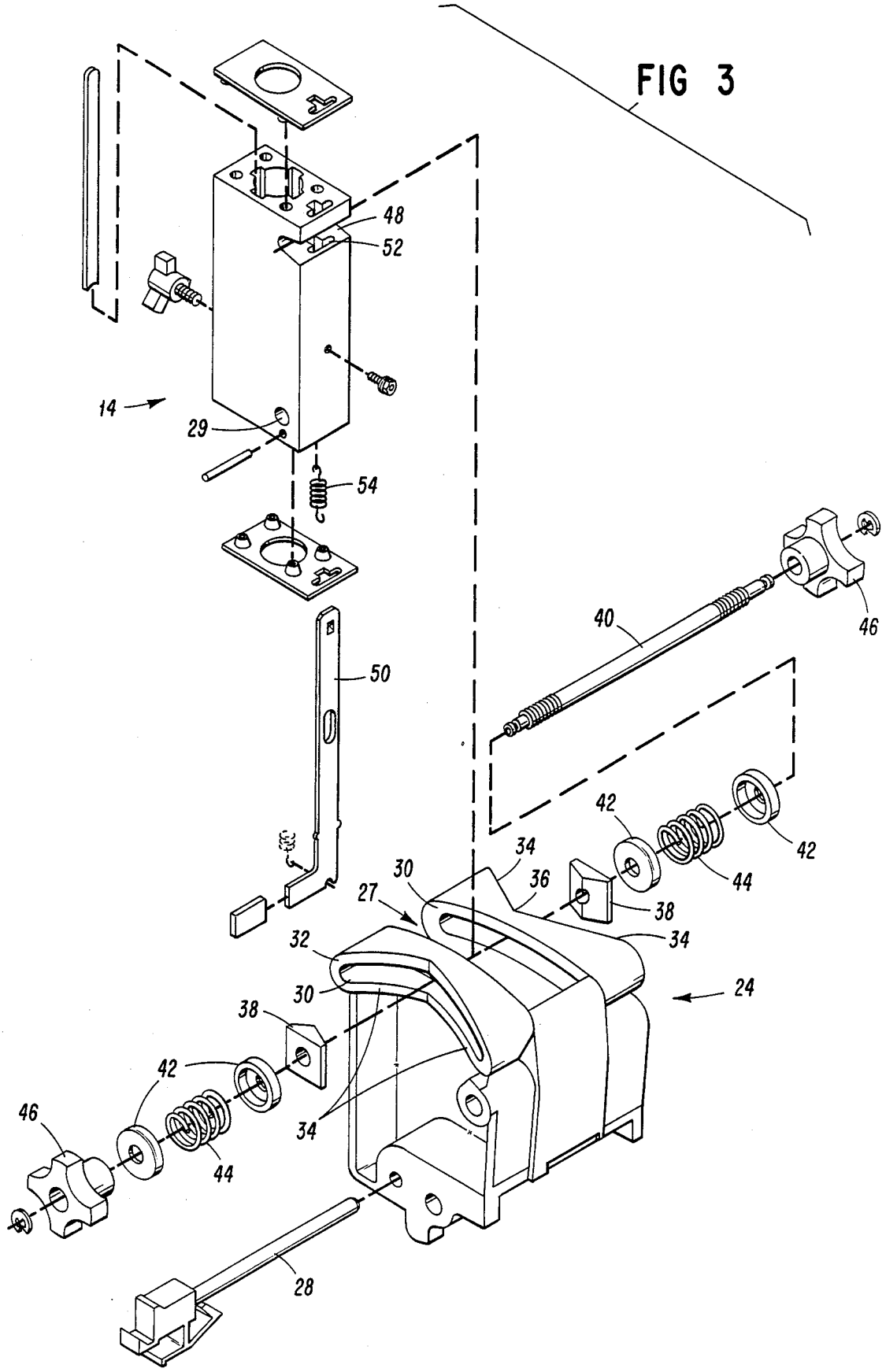
FIG. 3 is an exploded perspective view further illustrating the mounting of the electric trolling motor.

As shown in FIGS. 1 and 3, the swivel mounting bracket 14 that supports the motor tube 12 and the motor-propeller assembly 10 is positioned in a wide, deep recess 27 in mounting bracket 24 and is pivotally secured to the mounting bracket 24 by a pivot pin 28 that extends through an opening 29 in the lower inside corner of the swivel mounting bracket 14. Obviously, if there were no further connection between the swivel mounting bracket 14 and the mounting bracket 24, the motor assembly 10 would swing freely fore and aft in a generally vertical plane. Since the motor assembly 10 must be held in a fixed position relative to the boat, and thus relative to the mounting bracket 24, in order to provide the thrust to move the boat, means must be provided to secure the motor assembly 10 in a fixed operating position. If this were done simply provided a locking pin interconnecting the swivel mounting bracket 14 and mounting bracket 24, the motor would properly propel the boat, but if a submerged object were struck by the motor while the boat was moving, the motor assembly 10 and its supporting structure would most likely be damaged. Of course, a shear pin could be provided that would shear under a predetermined amount of force thus permitting the motor assembly 10 to pivot freely if an underwater object is struck. However, each time this occurs, which is not infrequently, the operator would have to replace the shear pin before proceeding, always being careful to carry an adequate supply of shear pins in the boat, and then manually reset the motor assembly to the operating position.

Therefore, the invention provides a structure which will allow the motor assembly 10 to pivot in either direction if a submerged object is struck while eliminating the need for shear pins and providing for automatic reset to the normal operating position. To accomplish this, the mounting bracket 24 is provided with an elongated and curved slot 30 extending on each side of recess 27, which slots therefore extend through bracket 24 from side-to-side. As best seen in FIGS. 1 and 3, the slots 30 are each curved on a radius the center of which is the pivot pin 28. Also, as best seen in FIG. 3, slots 30 extend to both the fore and aft ends of the mounting bracket 24.

Figure 2:
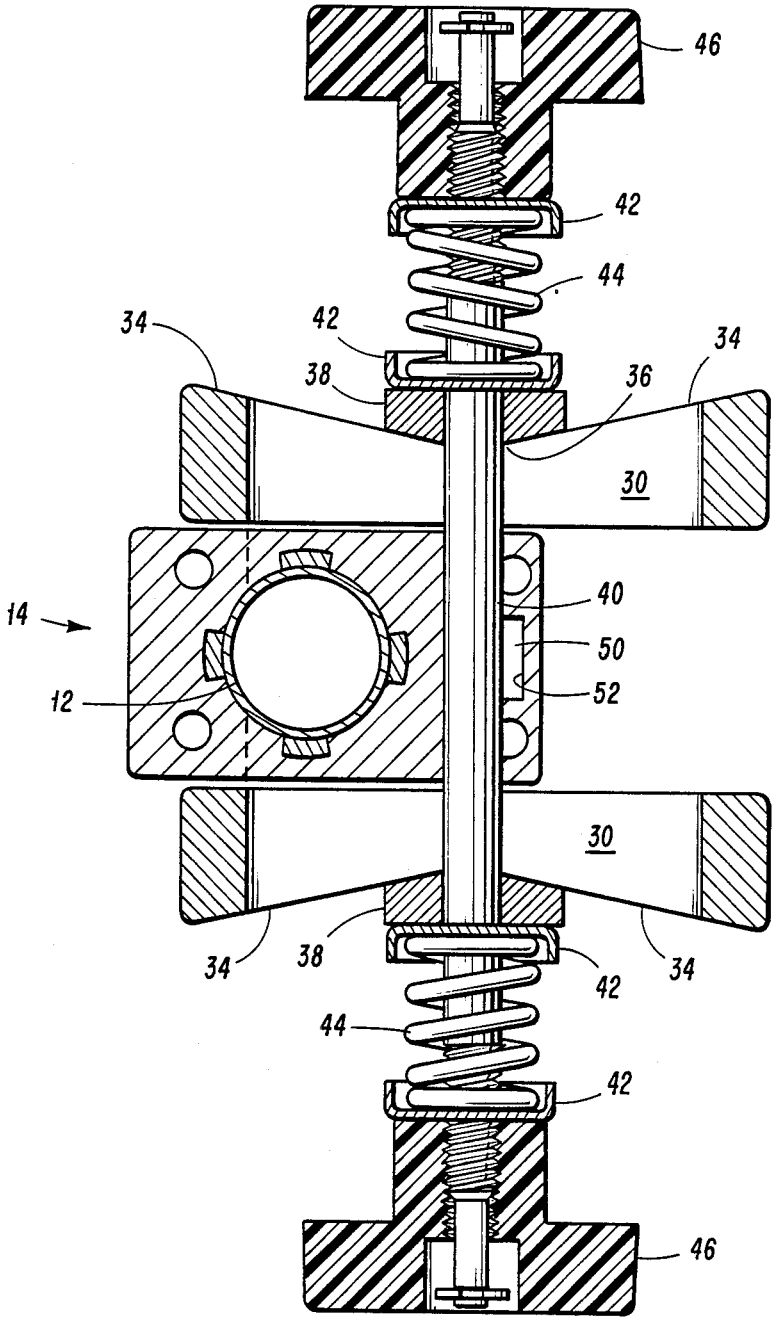
FIG. 2 is a sectional view taken on line 2—2 of FIG. 1.

Referring now to FIGS. 2 and 3, it will be seen that there are faces 32 on each side of the mounting bracket 24 encompassing each slot 30. These faces are flat and smooth and as shown in FIGS. 2 and 3, they diverge outwardly from a vertical plane extending both forwardly and rearwardly. Thus, the faces 32 surrounding the slot 30 on each side of the mounting bracket 24 provide ramps 34 extending outwardly both fore and aft from a center position 36. Engaged with ramps 34 on each side of mounting bracket 24 are thrust pads 38 the inner surfaces of which are shape to conform to the surfaces of the ramps 34 as shown in FIG. 2. In other words, the thrust pads 38 have their surfaces beveled so that when engaged in the center position 36 of the ramps 34, the thrust pads 38 will nest in that center position.

A thrust pin 40 extends through openings in the center of thrust pads 38 and also extends through slots 30. A pair of cup washers 42 on each side of a compression spring 44 are engaged over each outer end of thrust pin 40, and are held in place by a threaded tension knob 46 on each end of pin 40 which knobs 46 can be adjusted to vary the force exerted by compression spring 44 on each of the thrust pads 38. A single knob 46 on one end could be used with pin 40 being a cold-headed bolt.

To retain the swivel mounting bracket 14 in operating position relative to the mounting bracket 24, thrust pin 40 extends through an opening 48 in the upper part of the bracket 14 (See FIG. 3). Opening 48 preferably is a slot as shown, and to normally retain the thrust pin 40 in the slot 48, a latch 50 is vertically movable through a vertical opening 52 in bracket 14, the latch 50 being biased by a spring 54 to a position normally closing the open end of slot 48. This construction allows for quick disconnect of the motor assembly and is more fully described and claimed in my co-pending U.S. patent application Ser. No. 884,534, entitled "Quick Release Assembly for Electric Trolling Motors".

Since the thrust pin 40 extends through slots 30 in mounting bracket 24 on a radius the center of which is the pivot pin 28, when assembled as shown in the drawings and when in the normal operating position, the thrust pads 38 will be engaged at the center position 36 of the ramps 34 and will be held in that position by the compression springs 44. A predetermined amount.of force is applied to thrust pads 38 by compression springs 44, this force always being greater than the maximum thrust produced by the motor assembly 10. This will always normally keep the thrust pads 38 at the center position 36 of the ramps 34 and thus will maintain the motor assembly in its normal operating position with the motor tube 12 in a generally vertical position. This will also provide a solid drive connection between the motor assembly 10 and the boat.

However, if a submerged object is struck while the boat is moving to the left of FIG. 1, the force exerted on the motor assembly 10 and through the lever arm provided by the motor tube 12 to the swivel mounting bracket 14 will be sufficient to overcome the force of the compression springs 44 allowing them to further compress and allowing the thrust pads 38 to slide up the ramps 34, limited only by the length of the elongated slot 30. This release position is indicated by the dotted lines and labeled position "A" in FIG. 1. When the motor of assembly 10 clears the submerged object the thrust produced by motor assembly 10 and the force generated by compression springs 40 will automatically move the thrust pads 38 by to the center position 36 and return the motor assembly 10 to its normal operating position.

Similarly, if the motor assembly 10 is reversed to move the boat towards the right of FIG. 1, and if a submerged object is struck, the force exerted on the motor assembly 10 and through the lever arm provided by motor tube 12 onto the swivel mounting bracket 14 will be sufficient to overcome the force exerted by the compression springs 44 on the thrust pads 38 allowing them to move in the other direction up the ramps 34, limited only by the length of the slot 30. This release position is illustrated in FIG. 1 by dotted lines and is labeled position "B".

Thus, regardless of the direction of movement of the boat, if a submerged object is struck, the motor assembly 10 will be allowed to move out of the way and clear the submerged object without damaging the motor assembly 10 or its supporting structure. Because of the design of the mounting structure of the invention, and as seen in FIG. 1, the motor assembly can swing through a relatively wide arc thus permitting the motor assembly 10 to actually move a substantial vertical distance. With the mounting structure of the invention, and using an electric trolling motor of common size and design, this vertical distance will be approximately 7" which is substantially greater than any known automatic reset designs. Thus, the design of the invention will permit clearance of submerged objects not allowed by prior art designs.

Having thus described the invention in connection with a preferred embodiment thereof, it will be evident to those skilled in the art that various revisions and modifications can be made to the preferred embodiment without departing from the spirit and scope of the invention. It is my intention however that all such revisions and modifications as are evident and obvious to those skilled in the art will be included within the scope of the following claims.

What is claimed is:

1. A mounting structure for an outboard motor for boats comprising a mounting assembly for attachment to the boat, a bracket for supporting the motor which bracket is pivotally connected to the mounting assembly so as to provide for pivotal movement of the motor fore and aft, an arcuate slot in the mounting assembly vertically spaced from the pivotal connection with the bracket, a thrust member extending through the slot and operatively connected to the bracket, and means biasing the thrust member to a normal operating position in which the motor is held in its normal operating position, the thrust member being moveable in the slot from the normal operating position to allow the motor supporting bracket to pivot about its pivotal connection with the mounting assembly if the motor strikes an underwater object.

2. The mounting structure of claim 1 in which the arcuate slot in the mounting assembly has a center of radius that coincides with the pivot point of the pivotal connection between the motor supporting bracket and the mounting assembly.

3. The mounting structure of claim 2 in which there is a slot on each side of the mounting assembly and a friction surface surrounding each slot, friction pads engage the friction surfaces, the thrust member extends through the pads, and the means biasing the thrust member to the normal operating position biases the friction pads against the friction surfaces.

4. The mounting structure of claim 3 in which the friction surfaces around the slots each extend outwardly to form a ramp that is engageable by one of the friction pads, the innermost end of the ramp being the normal operating position.

5. The mounting structure of claim 4 in which each of the friction surfaces around the slots extends outwardly both fore and aft from an innermost position, the innermost position being the normal operating position.

6. The mounting structure of claim 5 in which the motor supporting bracket has an opening extending horizontally through it, and the thrust member is engaged in said opening.

7. The mounting structure of claim 6 in which the means biasing the thrust member to a normal operating position includes a compression spring surrounding each end of the thrust member and biasing a friction pad against the friction surface around each of the slots in the mounting assembly.

8. The mounting structure of claim 7 in which an adjusting member is provided on one end of the thrust member to vary the compression in the compression springs.

9. The mounting structure of claim 8 in which the adjusting member is a threaded member.

* * * * *